US009657970B2

(12) United States Patent
Morie et al.

(10) Patent No.: US 9,657,970 B2
(45) Date of Patent: May 23, 2017

(54) CRYOGENIC REFRIGERATOR

(71) Applicant: SUMITOMO HEAVY INDUSTRIES, LTD., Tokyo (JP)

(72) Inventors: Takaaki Morie, Tokyo (JP); Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 486 days.

(21) Appl. No.: 14/272,664

(22) Filed: May 8, 2014

(65) Prior Publication Data

US 2014/0338367 A1 Nov. 20, 2014

(30) Foreign Application Priority Data

May 16, 2013 (JP) ..... 2013-104502

(51) Int. Cl.
*F25B 9/14* (2006.01)
*F25B 9/10* (2006.01)

(52) U.S. Cl.
CPC *F25B 9/14* (2013.01); *F25B 9/10* (2013.01); *F25B 2500/01* (2013.01)

(58) Field of Classification Search
CPC .... F25B 9/00; F25B 9/14; F04B 37/08; F16K 3/04–3/10; F16K 11/00–11/24; F16K 31/041–31/045
USPC ..... 62/6; 251/208; 137/625.46
See application file for complete search history.

(56) References Cited

U.S. PATENT DOCUMENTS

2012/0047913 A1* 3/2012 Mizuno ..... F25B 9/14 62/6
2013/0025297 A1 1/2013 Matsubara et al.

FOREIGN PATENT DOCUMENTS

| | | | |
|---|---|---|---|
| JP | H06-300378 | 10/1994 | |
| JP | 10-089789 | 4/1998 | |
| JP | 2007-205581 | 8/2007 | |
| JP | WO 2011132563 A1 * | 10/2011 | ..... F16K 25/005 |
| WO | 2011-132563 | 10/2011 | |

* cited by examiner

*Primary Examiner* — Jianying Atkisson
*Assistant Examiner* — Antonio R Febles
(74) *Attorney, Agent, or Firm* — IPUSA, PLLC

(57) ABSTRACT

A cryogenic refrigerator includes a compressor, an expansion space where a high-pressure working gas discharged from a discharge side of the compressor is caused to expand, and a valve. The valve includes a first member including a first channel connecting to the discharge side and a second member including a second channel connecting to the expansion space. The first and second members are configured to rotate relative to and in contact with each other to connect or disconnect the first and second channels. In a plane where the first and second members are in contact, a first distance that is a distance of closest approach between the first channel and a valve circumference defined by a circumference of one of the first and second members having a smaller diameter is greater than a second distance that is a distance of closest approach between the second channel and the valve circumference.

3 Claims, 7 Drawing Sheets

CRYOGENIC REFRIGERATOR

CROSS-REFERENCE TO RELATED APPLICATION

This application is based upon and claims the benefit of priority of Japanese Patent Application No. 2013-104502, filed on May 16, 2013, the entire contents of which are incorporated herein by reference.

BACKGROUND

Technical Field

The present invention generally relates to cryogenic refrigerators including a rotary valve.

Description of Related Art

Gifford-McMahon (GM) refrigerators are known as refrigerators that produce cryogenic temperatures. In GM refrigerators, the volume of an expansion space is caused to change by the reciprocation of a displacer in a cylinder. A working gas is caused to expand in the expansion space by connecting the expansion space selectively to the suction side or the discharge side of a compressor in accordance with a change in the volume of the expansion space. A rotary valve may be used to switch the connection of the expansion space between a connection to the suction side and a connection to the discharge side.

SUMMARY

According to an aspect of the present invention, a cryogenic refrigerator includes a compressor, an expansion space in which a high-pressure working gas discharged from a discharge side of the compressor is caused to expand, and a valve. The valve includes a first member including a first channel connecting to the discharge side of the compressor, and a second member including a second channel connecting to the expansion space. The first member and the second member are configured to rotate relative to and in contact with each other to connect or disconnect the first channel and the second channel. In a plane in which the first member and the second member are in contact, a first distance that is a distance of closest approach between the first channel and a valve circumference defined by a circumference of one of the first member and the second member having a smaller diameter is greater than a second distance that is a distance of closest approach between the second channel and the valve circumference.

According to an aspect of the present invention, a cryogenic refrigerator includes a compressor, an expansion space in which a high-pressure working gas discharged from a discharge side of the compressor is caused to expand, and a valve. The valve includes a first member including a first channel connecting to the discharge side of the compressor, and a second member including a second channel connecting to the expansion space. At least one of the first member and the second member is caused to rotate to connect or disconnect the first channel and the second channel. In a plane in which the first member and the second member are in contact, a centroid of the first channel is closer to a center of a valve circumference than is a centroid of the second channel, the valve circumference being defined by a circumference of one of the first member and the second member having a smaller diameter.

It is to be understood that both the foregoing general description and the following detailed description are exemplary and explanatory and not restrictive of the invention.

DETAILED DESCRIPTION

As mentioned above, a rotary valve may be used to switch the connection of the expansion space in GM refrigerators. Some rotary valves switch channels provided on the sliding surfaces of a stator valve and a rotor valve by pressing the stator valve against the rotating rotor valve and causing the stator valve and the rotor valve to slide relative to each other. A working gas leakage at the sliding surfaces has a considerable effect over the performance of the cryogenic refrigerator. The sealing performance at the sliding surfaces is improved by, for example, increasing a force to press the stator valve against the rotor valve. Such improvement, however, is not preferable in view of an increase in the valve drive torque.

According to an aspect of the present invention, a cryogenic refrigerator in which a working gas leakage is reduced without an increase in the valve drive torque is provided.

According to an aspect of the present invention, it is possible to reduce a working gas leakage in a rotary valve.

A description is given, with reference to the accompanying drawings, of embodiments of the present invention.

Figure 1:
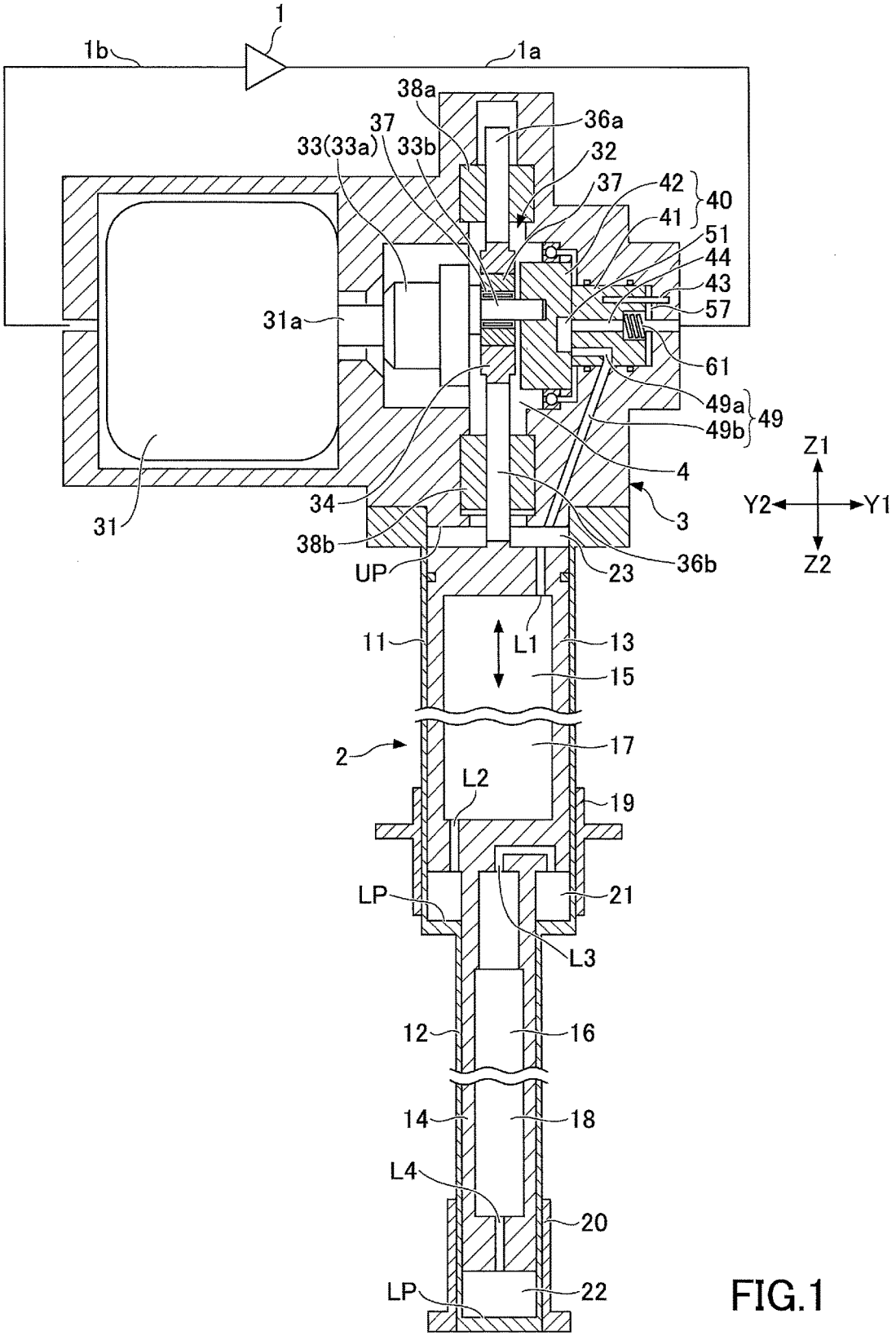
FIG. 1 is a cross-sectional view of a GM refrigerator that is an embodiment of the present invention.
Figure 2:
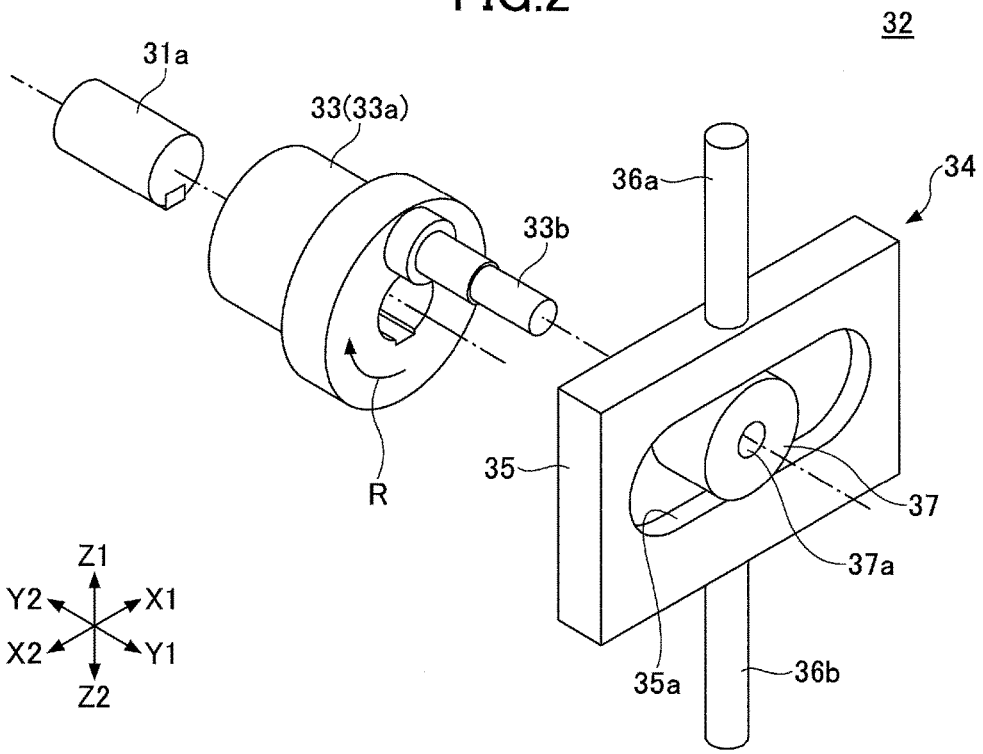
FIG. 2 is an enlarged exploded perspective view of a Scotch yoke mechanism.
Figure 3:
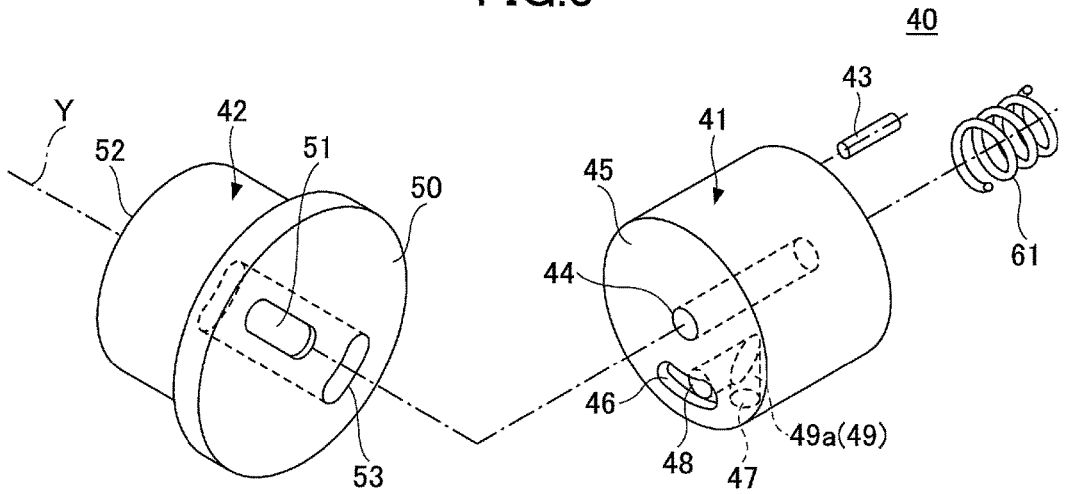
FIG. 3 is an enlarged exploded perspective view of a rotary valve.

FIG. 1, FIG. 2 and FIG. 3 are diagrams for illustrating a cryogenic refrigerator according to an embodiment of the present invention. In this embodiment, a description is given, taking a Gifford-McMahon refrigerator (hereinafter referred to as "GM refrigerator") as an example of a cryogenic refrigerator. A GM refrigerator according to this embodiment includes a compressor 1, a cylinder 2, and a housing 3. In FIG. 1, the direction indicated by arrow Z1 (Z1 direction) and the direction indicated by arrow Z2 (Z2 direction) represent an upward direction and a downward direction, respectively, with respect to the GM refrigerator. Furthermore, the directions indicated by arrows Y1 and Y2 (Y1 and Y2 directions) are directions perpendicular to the Z1 and Z2 directions. In FIG. 3, the directions indicated by arrows X1 and X2 (X1 and X2 directions) are directions perpendicular to the Z1 and Z2 directions and the Y1 and Y2 directions.

The compressor 1 takes in a low-pressure working gas from the suction side to which a return pipe 1*b* is connected. The compressor 1 compresses the working gas and thereafter supplies a high-pressure working gas to a supply pipe 1*a* connected to the discharge side. The working gas may be, but is not limited to, helium gas.

In this embodiment, by way of example, the GM refrigerator is a two-stage GM refrigerator. In the two-stage GM refrigerator, the cylinder 2 includes a first-stage cylinder 11 and a second-stage cylinder 12. A first-stage displacer 13 is inserted in the first-stage cylinder 11. A second-stage displacer 14 is inserted in the second-stage cylinder 12.

The first-stage and second-stage displacers 13 and 14 are interconnected and are configured to reciprocate in the axial directions of the first-stage and second-stage cylinders 11 and 12 inside the first-stage and second-stage cylinders 11 and 12, respectively. An internal space 15 is formed inside the first-stage displacer 13 and an internal space 16 is formed inside the second-stage displacer 14. The internal spaces 15 and 16 are filled with a regenerator material (not illustrated) and serve as regenerators 17 and 18, respectively.

The first-stage displacer 13, positioned higher than the second-stage displacer 14, is connected to a drive shaft 36*b* that extends in the Z1 and Z2 directions in FIG. 1. The drive shaft 36*b* constitutes part of a below-described Scotch yoke mechanism 32.

A gas channel L1 is formed in a high-temperature end portion (an upper end portion in FIG. 1) of the first-stage displacer 13. Furthermore, a gas channel L2 that connects the internal space 15 and a first-stage expansion space 21 is formed in a low-temperature end portion (a lower end portion in FIG. 1) of the first-stage displacer 13.

The first-stage expansion space 21 is formed in a low-temperature end portion (a lower end portion) of the first-stage cylinder 11. Furthermore, an upper chamber 23 is formed in a high-temperature end portion (an upper end portion in FIG. 1) of the first-stage cylinder 11.

Furthermore, a second-stage expansion space 22 is formed in a low-temperature end portion (a lower end portion in FIG. 1) of the second-stage cylinder 12.

The second-stage displacer 14 is attached to a lower portion of the first-stage displacer 13 by a connection mechanism (not illustrated). A gas channel L3 that connects the first-stage expansion space 21 and the internal space 16 is formed in a high-temperature end portion (an upper end portion in FIG. 1) of the second-stage displacer 14. Furthermore, a gas channel L4 that connects the internal space 16 and the second-stage expansion space 22 is formed in a low-temperature end portion (a lower end portion in FIG. 1) of the second-stage displacer 14.

A first-stage cooling stage 19 is provided at a position facing the first-stage expansion space 21 on an exterior circumferential surface of the first-stage cylinder 11. Furthermore, a second-stage cooling stage 20 is provided at a position facing the second-stage expansion space 22 on an exterior circumferential surface of the second-stage cylinder 12.

The first-stage and second-stage displacers 13 and 14 are caused to move upward and downward (in the Z1 and Z2 directions) in FIG. 1 inside the first-stage and second-stage cylinders 11 and 12, respectively, by the Scotch yoke mechanism 32.

FIG. 2 is an enlarged view of the Scotch yoke mechanism 32. The Scotch yoke mechanism 32 includes a crank 33 and a Scotch yoke 34. The Scotch yoke 32 may be driven by a drive part such as a motor 31, for example.

The crank 33 is fixed to a rotating shaft of the motor 31 (hereinafter referred to as "drive rotating shaft 31*a*"). The crank 33 includes a crank pin 33*b* provided at a position eccentric to a position at which the drive rotating shaft 31*a* is attached to the crank 33. Accordingly, the crank pin 33*b* is eccentric to the drive rotating shaft 31*a* with the crank 33 being attached to the drive rotating shaft 31.

The Scotch yoke 34 includes drive shafts 36*a* and 36*b*, a yoke plate 35, and a roller bearing 37. An accommodation space 4 is formed inside the housing 3. The accommodation space 4 accommodates the Scotch yoke 34 and a rotor valve 42 of a below-described rotary valve 40. The accommodation space 4 communicates with a suction port (not illustrated) of the compressor 1 via the return pipe 1*b*. Therefore, the pressure inside the accommodation space 4 is constantly kept low.

The drive shaft 36*a* extends upward (in the Z1 direction) from the yoke plate 35. The drive shaft 36*a* is supported by a sliding bearing 38*a* provided in the housing 3. Therefore, the drive shaft 36*a* is configured to move upward and downward (in the Z1 and Z2 directions) in FIG. 1 and FIG. 2.

The drive shaft 36*b* extends downward (in the Z2 direction) from the yoke plate 35. The drive shaft 36*b* is supported by a sliding bearing 38*b* provided in the housing 3. Therefore, the drive shaft 36*b* is configured to move upward and downward (in the Z1 and Z2 directions) in FIG. 1 and FIG. 2.

The drive shafts 36*a* and 36*b* are supported by the sliding bearings 38*a* and 38*b*, respectively, so that the Scotch yoke 34 is configured to move upward and downward (in the Z1 and Z2 directions) in FIG. 1 and FIG. 2 in the housing 3.

In this embodiment, the term "axial directions" may be used for an easier understanding of the positional relationship of elements of the cryogenic refrigerator. The axial directions refer to the directions in which the drive shafts 36*a* and 36*b* extend, and also coincide with the directions in which the first-stage and second-stage displacers 13 and 14 move. For convenience, with respect to each of the first-stage and second-stage displacers 13 and 14, relative proximity to the associated expansion space or cooling stage with respect to the axial directions may be expressed using the term "lower" or "bottom" and relative remoteness from the associated expansion space or cooling stage with respect to the axial directions may be expressed using the term "upper (higher)" or "top." That is, relative remoteness from the low-temperature end of the associated cylinder may be expressed using the term "upper (higher)" or "top" and relative proximity to the low-temperature end of the associated cylinder may be expressed using the term "lower" or "bottom." Furthermore, with respect to the movements of each of the displacers 13 and 14, a direction toward the associated expansion space or cooling stage, that is, the low-temperature end of the associated cylinder, with respect to the axial directions may be expressed as "downward direction" and a direction away from the associated expansion space or cooling stage, that is, the low-temperature end of the associated cylinder, with respect to the axial directions may be expressed as "upward direction." These expressions do not limit the position or orientation of attachment of the GM refrigerator. For example, the GM refrigerator may be attached with an expansion space being positioned higher in a cylinder in a vertical direction. In this case, for example, the term "upper (higher)" or "top" may be used to express relative proximity to the expansion space and an "upward direction" may be interpreted as corresponding to the downward direction in this embodiment.

A laterally elongated window 35*a* is formed in the yoke plate 35. The laterally elongated window 35*a* is elongated in directions to cross the directions in which the drive shafts 36*a* and 36*b* extend. For example, the laterally elongated window 35*a* is elongated in directions (the X1 and X2 directions in FIG. 2) perpendicular to the directions in which the drive shafts 36*a* and 36*b* extend.

The roller bearing 37 is provided in the laterally elongated window 35*a*. The roller bearing 37 is configured to roll inside the laterally elongated window 35*a*. Furthermore, a hole 37*a* that engages with the crank pin 33*b* is formed in the center of the roller bearing 37.

When the motor 31 is driven to rotate the drive rotating shaft 31*a*, the crank pin 33*b* rotates in a circular motion in a direction indicated by arrow R in FIG. 2. As a result, the roller bearing 37 reciprocates in the X1 and X2 directions inside the laterally elongated window 35*a*, so that the Scotch yoke 34 reciprocates in the Z1 and Z2 directions in FIG. 2.

The first-stage displacer 13 is connected to the drive shaft 36*b* of the Scotch yoke 34. As a result, with the reciprocation of the Scotch yoke 34 in the Z1 and Z2 directions in FIG. 2, the first-stage displacer 13 and the second-stage displacer 14 connected to the first-stage displacer 13 also reciprocate in the Z1 and Z2 directions inside the first-stage and second-stage cylinders 11 and 12, respectively.

Next, a description is given of a valve mechanism. In this embodiment, the rotary valve 40 is used as a valve mechanism.

The rotary valve 40 switches working gas channels. The rotary valve 40 operates as a supply valve that guides a high-pressure working gas discharged from the discharge side of the compressor 1 to the upper chamber 23 of the first-stage cylinder 11, and operates as a return valve that guides a working gas from the upper chamber 23 to the suction side of the compressor 1.

Referring to FIG. 3 as well as FIG. 1, the rotary valve 40 includes a stator valve 41 and the rotary valve 42. The stator valve 41 includes a flat stator-side sliding surface 45. Likewise, the rotor valve 42 includes a flat rotor-side sliding surface 50. A working gas leakage is controlled by the surface contact of the stator-side sliding surface 45 and the rotor-side sliding surface 50. (This is described in detail below.)

The stator valve 41 is fixed inside the housing by a fixing pin 43. The stator valve 41 is prevented from rotating by being fixed by the fixing pin 43.

The rotor valve 42 includes an opposite end surface 52 positioned on the side opposite to the rotor-side sliding surface 50. An engagement hole (not illustrated) that engages with the crank pin 33*b* is formed on the opposite end surface 52. The crank pin 33*b* is passed through the roller bearing 37 with an end portion of the crank pin 33*b* projecting in the Y1 direction from the roller bearing 37 (FIG. 1).

The end portion of the crank pin 33*b* projecting from the roller bearing 37 engages with the engagement hole formed in the rotor valve 42. Therefore, by the rotation (eccentric rotation) of the crank pin 33*b*, the rotor valve 42 is caused to rotate in synchronization with the Scotch yoke mechanism 32.

The stator valve 41 includes a working gas supply hole 44, an arc-shaped groove 46, and a valve-side channel 49*a*. The working gas supply hole 44 is connected to the supply pipe 1*a* of the compressor 1, and is formed through the central portion of the stator valve 41.

The arc-shaped groove 46 is formed on the stator-side sliding surface 45. The arc-shaped groove 46 has the shape of an arc of a circle whose center is at the working gas supply hole 44.

A gas channel 49 is formed in the stator valve 41 and the housing 3. The gas channel 49 includes the valve-side channel 49*a* formed in the stator valve 41 and a housing-side channel 49*b* formed in the housing 3.

Referring to FIG. 3, a first end portion of the valve-side channel 49*a* is open inside the arc-shaped groove 46 to form an opening 48. A second end portion of the valve-side channel 49*a* is open on a side surface of the stator valve 41 to form an opening 47.

The second end portion of the valve-side channel 49*a* communicates with a first end portion of the housing-side channel 49*b*. A second end portion of the housing-side channel 49*b* connects to the first-stage expansion space 21 via the upper chamber 23, the gas channel L1, and the regenerator 17.

On the other hand, the rotor valve 42 includes an oblong groove 51 and an arc-shaped hole 53.

The oblong groove 51 is formed on the rotor-side sliding surface 50 so as to extend radially from the center of the rotor-side sliding surface 50. Furthermore, the arc-shaped hole 53 extends from the rotor-side sliding surface 50 to the opposite end surface 52 through the rotor valve 42 to connect to the accommodation space 4. The arc-shaped hole 53 is formed so as to be positioned on the same circumference as the arc-shaped groove 46 of the stator valve 41.

The above-described working gas supply hole 44, the oblong groove 51, the arc-shaped groove 46, and the opening 48 form a supply valve. Furthermore, the opening 48, the arc-shaped groove 46, and the arc-shaped hole 53 form a return valve. In this embodiment, spaces inside the rotary valve 40, such as the oblong groove 51 and the arc-shaped groove 46, may be collectively referred to as "valve internal spaces."

In the GM refrigerator configured as described above, when the Scotch yoke mechanism 32 is driven by the motor 31, the Scotch yoke 34 reciprocates in the Z1 and Z2 directions. This motion of the Scotch yoke 34 causes the first-stage and second-stage cylinders 13 and 14 to reciprocate between their respective bottom dead centers and top dead centers inside the first-stage and second-stage cylinders 11 and 12, respectively.

When the first-stage and second-stage displacers 13 and 14 reach their respective bottom dead centers, the return valve is closed and the supply valve is opened. That is, a working gas channel is formed between the working gas supply hole 44 and the gas channel 49 through the oblong groove 51 and the arc-shaped groove 46.

Accordingly, a high-pressure working gas starts to fill in the upper chamber 23 from the compressor 1. Thereafter, the first-stage and second-stage displacers 13 and 14 pass their respective bottom dead centers and start to move upward, so that the working gas passes through the regenerators 17 and 18 from top to bottom to fill in the first-stage and second-stage expansion spaces 21 and 22.

When the first-stage and second-stage displacers 13 and 14 reach their respective top dead centers, the supply valve is closed and the return valve is opened. That is, a working gas channel is formed between the gas channel 49 and the arc-shaped hole 53 through the arc-shaped groove 46.

As a result, the high-pressure working gas generates cooling by expanding inside the first-stage and second-stage expansion spaces 21 and 22, and cools the first-stage and second-stage cooling stages 19 and 20. Furthermore, the low-temperature working gas that has generated cooling flows from bottom to top through the regenerators 17 and 18 while cooling the regenerator materials inside, and thereafter returns to the return pipe 1*b* of the compressor 1.

Thereafter, when the first-stage and second-stage displacers 13 and 14 reach their respective bottom dead centers, the return valve is closed and the supply valve is opened, so that one cycle is completed. By thus repeating the compression and expansion cycle of a working gas, each of the first-stage and second-stage cooling stages 19 and 20 of the GM refrigerator is cooled to cryogenic temperatures.

Here, a detailed description is further given, focusing on the sliding positions of the stator-side sliding surface 45 and the rotor-side sliding surface 50 of the rotary valve 40.

As described above, the rotary valve 40 switches working gas channels by the rotation of the rotor valve 42 relative to the stator valve 41. At this point, the stator-side sliding surface 45 and the rotor-side sliding surface 50 are desired to be airtight.

Therefore, according to this embodiment, the rotary valve 40 includes an urging part such as a spring 61, and the stator valve 41 is pressed against the rotor valve 42 by this spring 61 for the airtightness between the stator-side sliding surface 45 and the rotor-side sliding surface 50. Instead of the spring 61, the pressure of a working gas may be used to urge the stator valve 41 against the rotor valve 42.

In the following description, a plane in which the stator-side sliding surface 45 and the rotor-side sliding surface 50 are in contact may be referred to as "sealing plane 60."

The working gas supply hole 44 and the arc-shaped groove 46 are formed on the stator-side sliding surface 45 and the oblong groove 51 and the arc-shaped hole 53 are formed on the rotor-side sliding surface 50. The position of the arc-shaped groove 46 and the positions of the oblong groove 51 and the arc-shaped hole 53 relative to each other in the sealing plane 60 change with the rotation of the rotor valve 42.

Furthermore, the working gas supply hole 44 is constantly supplied with a high-pressure working gas from the compressor 1 via the supply pipe 1*a*. Therefore, the oblong groove 51 that constantly communicates with the working gas supply hole 44 is constantly supplied with a high-pressure working gas.

The pressure of the working gas acts as a force to separate the stator-side sliding surface 45 and the rotor-side sliding surface 50. In other words, the pressure of the working gas acts as a force to reduce the sealing between the stator-side sliding surface 45 and the rotor-side sliding surface 50.

Furthermore, the accommodation space 4 in which the rotor valve 42 is provided is a space connected to the return pipe 1*b*, and is lower in pressure than the working gas supplied through the supply pipe 1*a*. Accordingly, reduction in the sealing at the sealing plane 60 may result in a leakage of a high-pressure working gas to the low-pressure accommodation space 4.

It is desired to reduce a working gas leakage from the sealing plane 60 irrespective of the rotational state of the rotary valve 42 relative to the stator valve 41. That is, it is desired to reduce a working gas leakage from the sealing plane 60 in any relationship of the position of the arc-shaped groove 46 and the positions of the oblong groove 51 and the arc-shaped hole 53 relative to each other, even when there is a change in their relative positional relationship with the rotation of the rotor valve 42.

Figure 4:
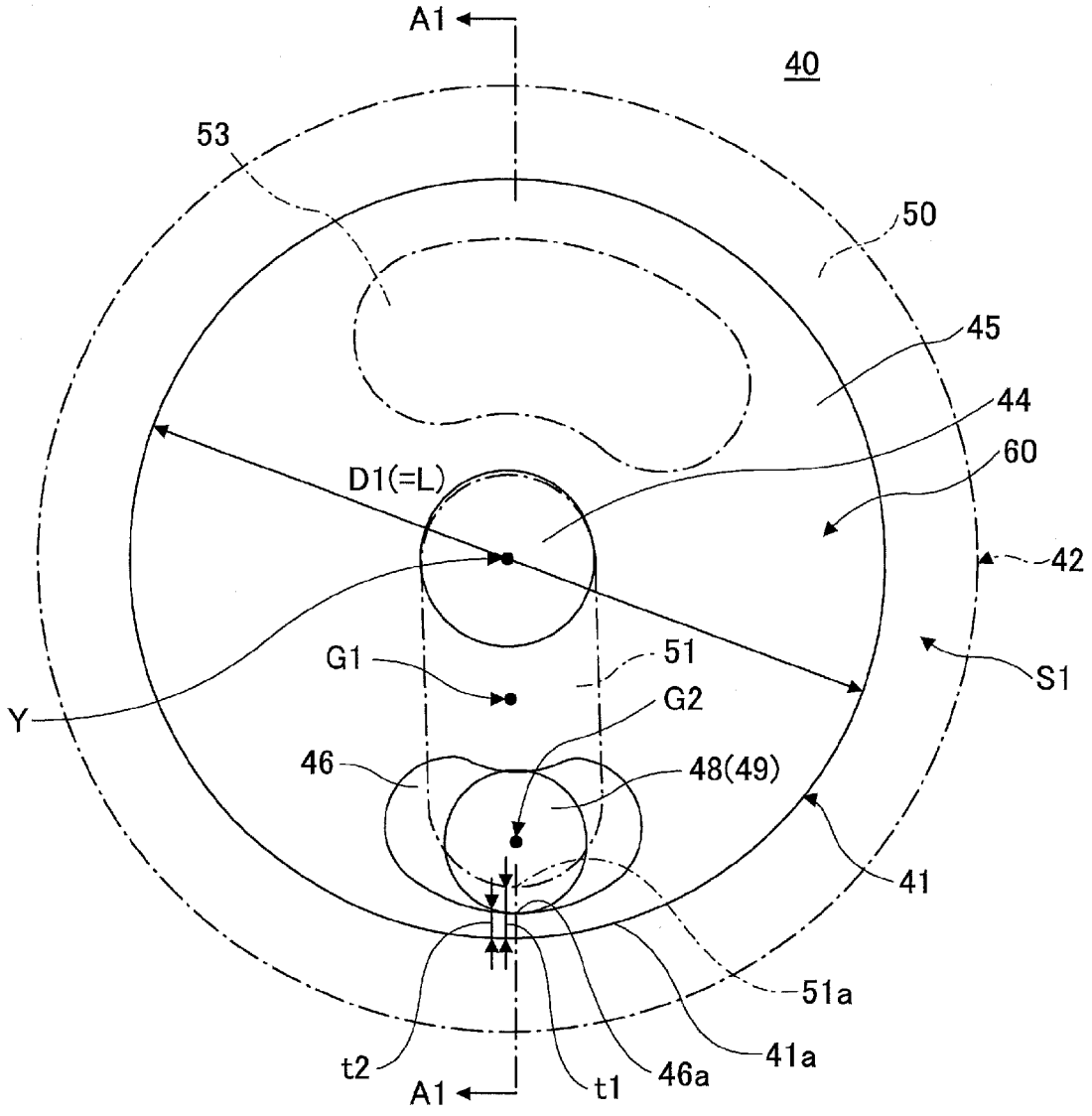
FIG. 4 is a diagram illustrating a state where a groove of a rotor of the rotary valve and an arc-shaped groove of a stator of the rotary valve are in communication with each other.

FIG. 4 illustrates the rotary valve 40 at the time of supplying a working gas to the upper chamber 23 of the first-stage cylinder 11. Furthermore, FIG. 5 is a cross-sectional view taken along a plane including line A1-A1 in FIG. 4.

FIG. 4 illustrates the rotary valve 40 viewed in a direction along its rotation center axis Y. In FIG. 4, components of the stator valve 41 are indicated by a solid line and components of the rotor valve 42 are indicated by a one-dot chain line. The rotor valve 42 rotates about the rotation center axis Y, about which the rotor valve 42 is coaxial with the stator valve 41.

Figure 5:
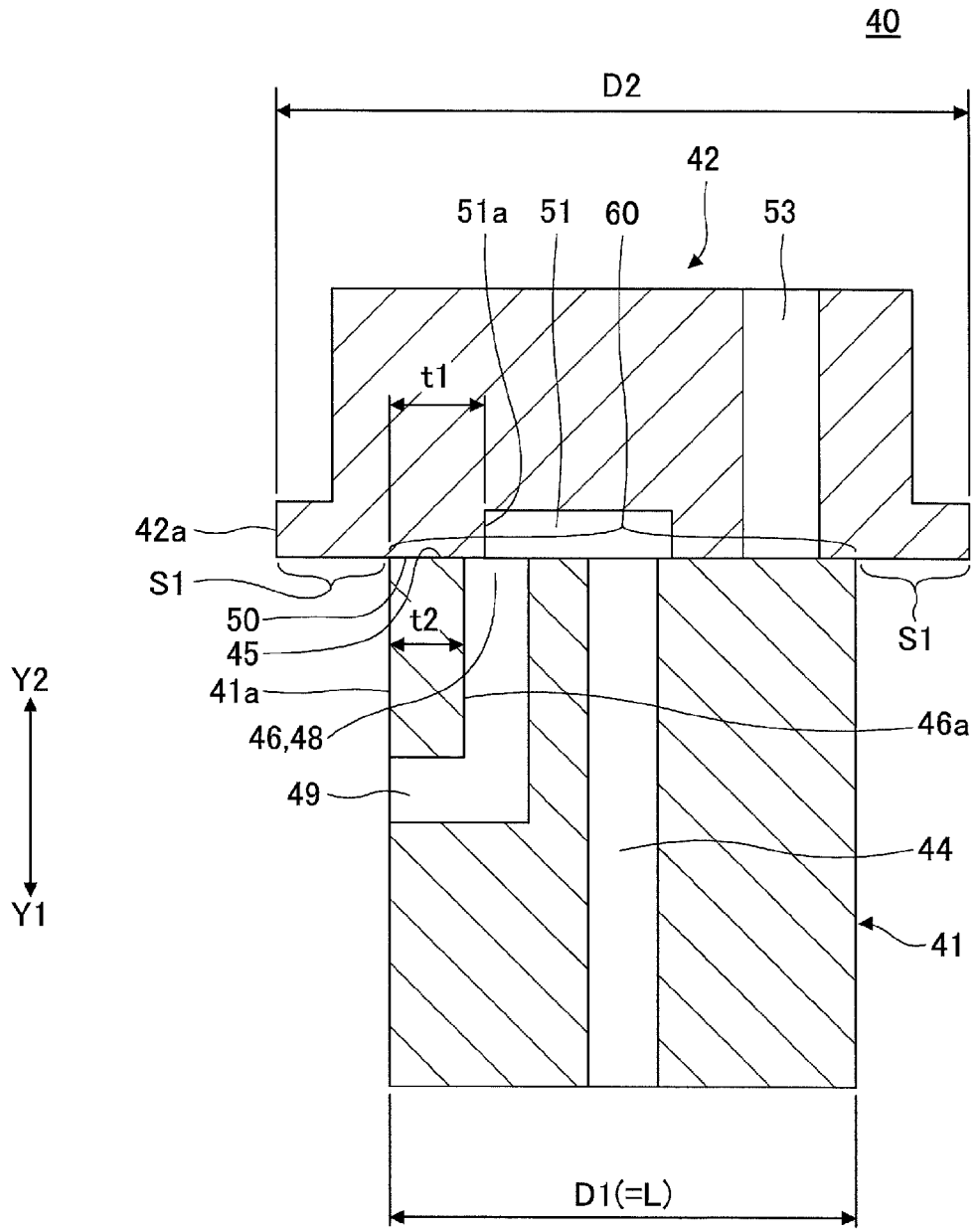
FIG. 5 is a cross-sectional view of the rotary valve taken along a plane including a line A1-A1 in FIG. 4.

Here, in the sealing plane 60 (contact plane) of the stator valve 41 and the rotor valve 42, the circumference of one of the stator valve 41 and the rotor valve 42 that is smaller in diameter is referred to as "valve circumference." Furthermore, the diameter of the valve circumference is referred to as "valve diameter L" (FIG. 4 and FIG. 5).

Figure 8:
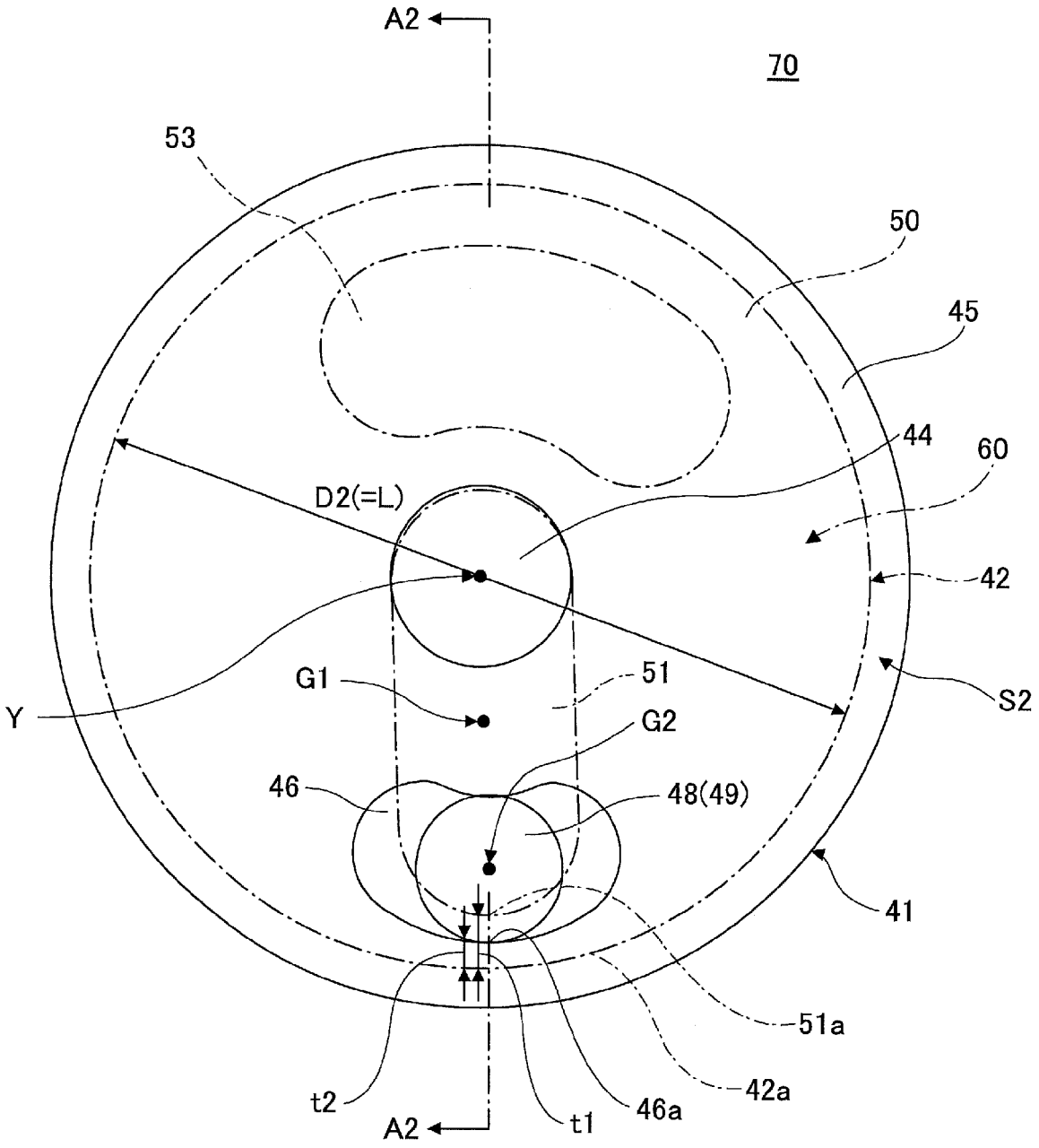
FIG. 8 is an enlarged view of sliding surfaces of a rotary valve of a GM refrigerator that is another embodiment of the present invention.
Figure 9:
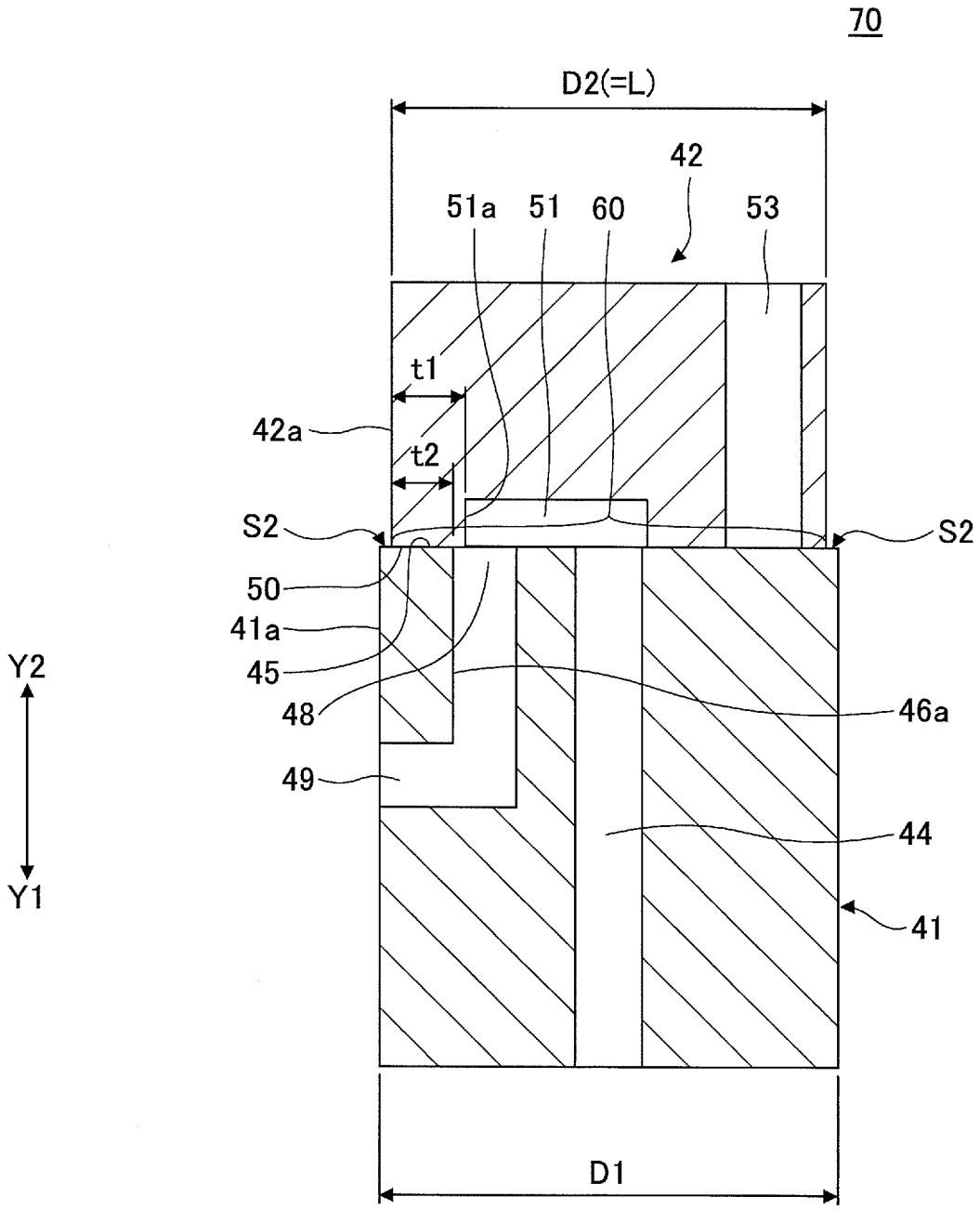
FIG. 9 is a cross-section view of the rotary valve taken along a plane including a line A2-A2 in FIG. 8.

In this embodiment, the rotor valve 42 is larger in diameter than the stator valve 41 in the sealing plane 60. Therefore, the valve circumference is the circumference of the stator valve 41, and the valve diameter L is a diameter D1 of the stator valve 41. On the other hand, if the rotor valve 42 is smaller in diameter than the stator valve 41 in the sealing plane 60, the valve circumference is the circumference of the rotor valve 42, and the valve diameter L is a diameter D2 of the rotor valve 42 (FIG. 8 and FIG. 9). Furthermore, a position at which the distance to the valve circumference is shortest in each valve internal space is referred to as "outermost position."

The sealing performance between the oblong groove 51 and the accommodation space 4 depends on the distance between the oblong groove 51 and the accommodation space 4 in the sealing plane 60. As this distance increases, the sealing performance is improved and the amount of leakage of a working gas from the oblong groove 51 to the accommodation space 4 is reduced. Here, the distance of closest approach between the area of the oblong groove 51 and the area of the accommodation space 4 is defined as a first sealing length t1. That is, the first sealing length t1 is the shortest distance between an outermost position 51*a* of the oblong groove 51 and the valve circumference.

Likewise, the sealing performance between the arc-shaped groove 46 and the accommodation space 4 depends on the distance between the arc-shaped groove 46 and the accommodation space 4 in the sealing plane 60. As this distance increases, the sealing performance is improved and the amount of leakage of a working gas from the arc-shaped groove 46 to the accommodation space 4 is reduced. Here, the distance of closest approach between the area of the arc-shaped groove 46 and the area of the accommodation space 4 is defined as a second sealing length t2. That is, the second sealing length t2 is the shortest distance between an outermost position 46*a* of the arc-shaped groove 46 and the valve circumference.

It is desirable to increase the first and second sealing lengths t1 and t2 in order to improve the sealing performance of the rotary valve 40. As the first and second sealing lengths t1 and t2 increases, however, the valve diameter L increases. An increase in the valve diameter L, which would result in an increase in the drive torque and an increase in the structural size, is not preferable.

Furthermore, the amount of leakage of a working gas from the valve internal spaces of the rotary valve 40 to the accommodation space 4 also depends on a pressure difference between valve internal spaces. The amount of leakage of a working gas is greater with a larger difference between two valve internal spaces. Thus, attention is given to the amount of leakage of a working gas per cooling cycle.

The oblong groove 51 is constantly connected to the discharge side of the compressor 1. Therefore, the working gas pressure of the oblong groove 51 is constantly high during one cycle. That is, the average working gas pressure of the oblong groove 51 per cycle is equal to the pressure of a high-pressure working gas discharged from the discharge side of the compressor 1.

On the other hand, the arc-shaped groove 46 is connected to the first-stage and second-stage displacers 13 and 14 via the gas channel 49. Therefore, the working gas pressure of the arc-shaped groove 46 is equal to the pressure of each of the first-stage and second-stage displacers 13 and 14 (the first-stage and second-stage expansion spaces 21 and 22). During one cycle, the first-stage and second-stage expansion spaces 21 and 22 are connected selectively to the discharge side or the suction side of the compressor 1. Therefore, the average working gas pressure of the arc-shaped groove 46 per cycle is lower than the pressure of a high-pressure working gas discharged from the discharge side of the compressor 1.

Accordingly, the amount of leakage of a working gas from the oblong groove 51 to the accommodation space 4 per cycle is greater than the amount of leakage of a working gas from the arc-shaped groove 46 to the accommodation space 4 per cycle. That is, the sealing required for the arc-shaped groove 46 is less than the sealing required for the oblong groove 51.

Thus, according to this embodiment, the first sealing length t1 is determined to be greater than the second sealing length t2. According to this configuration, it is possible to reduce the amount of leakage of a working gas from the valve internal spaces to the accommodation space 4 while preventing an increase in the rotary valve size.

Figure 6:
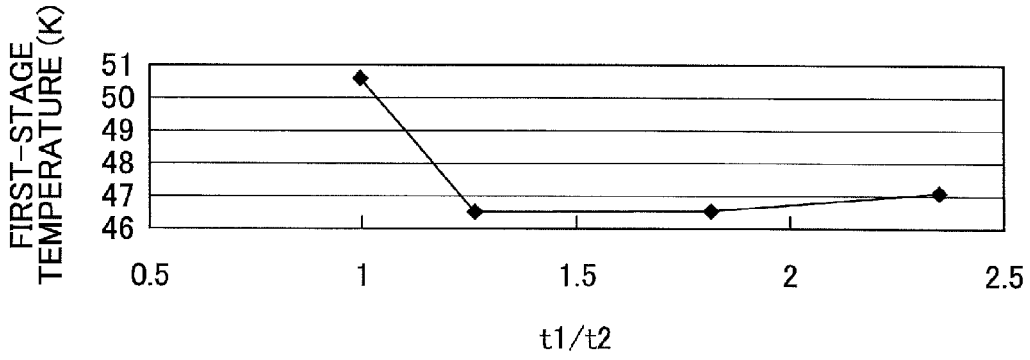
FIG. 6 is a graph illustrating a relationship between a valve sealing length ratio and cooling performance.

FIG. 6 is a graph illustrating the result of determining the relationship between the ratio of the first sealing length t1 to the second sealing length t2 (t1/t2) and the cooling performance of a GM refrigerator by an experiment. In the example experiment illustrated in FIG. 6, the first-stage temperature of a two-stage GM refrigerator was evaluated as the cooling performance of a GM refrigerator.

As illustrated in FIG. 6, when (t1/t2)=1, the cooling temperature is approximately 50.5 K. On the other hand, as the first sealing length t1 becomes greater than the second sealing length t2, the cooling temperature decreases, and when (t1/t2)=1.25 or more, the cooling temperature is reduced to approximately 46.5 K to approximately 47.1 K.

Thus, the result of the experiment illustrated in FIG. 6 demonstrates that causing the first sealing length t1 to be greater than the second sealing length t2 improves sealing and thus improves the cooling performance of a GM refrigerator.

Next, attention is given to the disposition of the arc-shaped groove 46 formed on the stator-side sliding surface 45 and the oblong groove 51 formed on the rotor-side sliding surface 50 in the sealing plane 60.

This disposition is illustrated with reference to the centroid of the arc-shaped groove 46 formed on the stator-side sliding surface 45 and the centroid of the oblong groove 51 formed on the rotor-side sliding surface 50 in the sealing plane 60. The centroid refers to the center of gravity of a plane figure. As illustrated in FIG. 4, the centroid of the oblong groove 51 in the sealing plane 60 is determined as a first centroid G1 and the centroid of the arc-shaped groove 46 is determined as a second centroid G2.

As described above, the working gas supply hole 44 to which a high-pressure working gas is supplied from the compressor 1 is provided in the center of the stator-side sliding surface 45. Therefore, the position of the working gas supply hole 44 is the center of the sealing plane 60. The oblong groove 51 extends radially from the center of the sealing plane 60.

On the other hand, the arc-shaped groove 46 is formed at a position near the circumference of the stator-side sliding surface 45. This position is placed over a radial outer end portion of the oblong groove 51 and its vicinity. Therefore, the position of the arc-shaped groove 46 is a position near the circumference of the sealing plane 60.

According to this embodiment, the first sealing length t1 is determined to be greater than the second sealing length t2 (t1>t2). That is, the arc-shaped groove 46 is disposed at a position closer to the circumference than is the oblong groove 51. Therefore, in the sealing plane 60, the position of the first centroid G1 is closer to the center position (which is the same as the position of the rotation center axis Y) than is the second centroid G2.

Next, a description is given of the relationship between the diameter of the sealing plane 60 and the first sealing length t1.

As described above, the valve diameter L is the smaller of the diameter D1 of the stator valve 41 and the diameter D2 of the rotor valve 42. As illustrated in FIG. 4 and FIG. 5, the diameter D1 of the stator valve 41 is the valve diameter L in this embodiment.

Furthermore, as described above, the first sealing length t1 is the distance between the outermost position 51*a* of the oblong groove 51 and an outermost circumferential position of the sealing plane 60. Therefore, in this embodiment, the first sealing length t1 is the distance between the outermost position 51*a* of the oblong groove 51 and a stator circumferential position 41*a*.

The sealing between the stator-side sliding surface 45 and the rotor-side sliding surface 50 in the sealing plane 60 changes depending on the first sealing length t1. That is, it is possible to increase the sealing by increasing the valve diameter L while maintaining the shape of the oblong groove 51.

An increase in the valve diameter L, however, would result in an increase in the size of the rotary valve 40. Therefore, the valve diameter L may be restricted by the size of a GM refrigerator so as to be limited in length.

On the other hand, increasing the first sealing length t1 by changing the shape of the oblong groove 51 while maintaining the valve diameter L may reduce the sealing between the working gas supply hole 44 and the arc-shaped groove 46 and the opening 48 or increase pressure loss generated when a working gas flows from the oblong groove 51 to the arc-shaped groove 46. Therefore, in order to increase sealing in the sealing plane 60, it is preferable that the first sealing length t1 and the valve diameter L be designed so as to be in an appropriate ratio.

Figure 7:
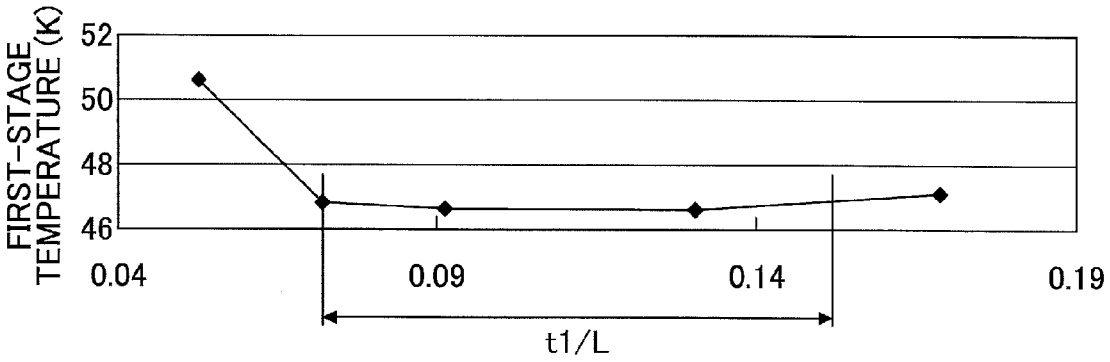
FIG. 7 is a graph illustrating a relationship between the ratio of a valve sealing length to a valve diameter and cooling performance.

FIG. 7 is a graph illustrating the relationship between the ratio of the first sealing length t1 to the valve diameter L (t1/L) and the cooling performance of a GM refrigerator. In the example experiment illustrated in FIG. 7, a two-stage GM refrigerator was used, and the first-stage cooling temperature of the GM refrigerator is shown on the vertical axis in FIG. 7.

As illustrated in FIG. 7, the cooling temperature of the GM refrigerator decreases as the value of (t1/L) increases. Then, the cooling temperature becomes the lowest cooling temperature (approximately 46.5 K) in the range of (t1/L) values of 0.07 to 0.16. Then, the cooling temperature exhibits the characteristic of slowly increasing thereafter. It is believed that in the range of (t1/L) values less than 0.07, the cooling temperature rapidly decreases because the sealing performance is improved with an increase in (t1/L).

On the other hand, it is believed that in the range of (t1/L) values exceeding 0.16, the effect of an increase in pressure loss generated when a working gas flows from the oblong groove 51 to the arc-shaped groove 46 is on the cooling temperature.

In some use, GM refrigerators may be determined as having a problem with their cooling performance when the degradation of cooling performance exceeds 2%. Therefore, according to this embodiment, letting a range where the degradation of cooling performance exceeds 2% be abnormal, it is preferable that the ratio of the first sealing length t1 to the valve diameter L (t1/L) be in the range of $0.07 \leq (t1/L) \leq 0.16$.

Next, a description is given of another embodiment of the present invention.

FIG. 8 and FIG. 9 are enlarged views of a rotary valve 70 of a GM refrigerator that is another embodiment.

This embodiment may have the same configuration as that illustrated in FIG. 1 through FIG. 5 except for the configuration of the rotary valve 70. Accordingly, the rotary valve 70 alone is described with its graphical representation in the description of this embodiment. Furthermore, in FIG. 8 and FIG. 9, the same elements as those illustrated in FIG. 1 through FIG. 5 are referred to by the same reference numerals, and their description is omitted.

In the above-described embodiment, the diameter D2 of the rotor valve 42 is larger than the diameter D1 of the stator valve 41 (D2>D1). On the other hand, according to the rotary valve 70 of this embodiment, the diameter D1 of the stator valve 41 is larger than the diameter D2 of the rotor valve 42 (D1>D2).

It is determined based on the materials of the stator valve 41 and the rotor valve 42 which one of the diameter D1 of the stator valve 41 and the diameter D2 of the rotor valve 42 is larger than the other. Therefore, the size relationship of the diameter D1 of the stator valve 41 and the diameter D2 of the rotor valve 42 may be reversed as in the case of the rotary valve 40 of the above-described embodiment and the rotary valve 70 of this embodiment.

In the case where the diameter D1 of the stator valve 41 is larger than the diameter D2 of the rotor valve 42, the area of the stator-side sliding surface 45 outside the rotor-side sliding surface 50 (an area indicated by arrow S2 in FIG. 8 and FIG. 9) is an area that does not contribute to control of a working gas leakage.

In this embodiment, the stator valve 41 is larger in diameter than the rotor valve 42 in the sealing plane 60 (contact plane). Therefore, the valve circumference is the circumference of the rotor valve 42 and the valve diameter L is the diameter D2 of the rotor valve 42.

Furthermore, in this embodiment as well, increasing the valve diameter L solely to improve the sealing performance of the rotary valve 40, which would result in an increase in the drive torque and an increase in the structural size, is not preferable. Furthermore, the amount of leakage of a working gas from the oblong groove 51 to the accommodation space 4 per cycle is greater than the amount of leakage of a working gas from the arc-shaped groove 46 to the accommodation space 4 per cycle. Therefore, the sealing required for the arc-shaped groove 46 is less than the sealing required for the oblong groove 51.

The above-described points are the same as in the above-described embodiment (the embodiment illustrated in FIG. 1 through FIG. 5).

Therefore, in this embodiment as well, the first sealing length t1 is determined to be greater than the second sealing length t2 (t1>t2). Accordingly, in this embodiment as well, the position of the first centroid G1 in the sealing plane 60 is closer to the center position of the sealing plane 60 (which is the same as the position of the rotation center axis Y) than is the second centroid G2. Furthermore, like in the above-described embodiment, the ratio of the first sealing length t1 to the valve diameter L (t1/L) is desired to be in the range of $0.07 \leq (t1/L) \leq 0.16$.

This configuration makes it possible to improve the sealing at the sealing plane 60 and the cooling performance of the GM refrigerator and also to reduce the size of the rotary valve 70.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

That is, while the above description is given, taking a GM refrigerator as an example, embodiments of the present invention may also be applied to various cryogenic refrigerators such as pulse tube refrigerators and Solvay refrigerators. Furthermore, while a Scotch yoke mechanism is described as an example of a mechanism for driving displacers, displacers may alternatively be driven by a linear motor.

Furthermore, in the above-described embodiments, a description is given of the case where the accommodation space 4 is connected to the suction side of the compressor 1. Embodiments of the present invention, however, are not limited to this configuration. For example, the accommodation space 4 may be connected to the discharge side of the compressor 1. When the accommodation space 4 is a high-pressure space, a working gas leaks out from the accommodation space 4 to the inside of the valve. In this case, the oblong groove 51 is constantly connected to the discharge side of the compressor 1. Therefore, the average pressure of the oblong groove 51 per cycle is lower than the average pressure of the arc-shaped groove 46 per cycle.

What is claimed is:

1. A cryogenic refrigerator, comprising:

a compressor;

an expansion space in which a high-pressure working gas discharged from a discharge side of the compressor is caused to expand; and a valve including a first member including a first channel connecting to the discharge side of the compressor; and a second member including a second channel connecting to the expansion space, wherein the first member and the second member are configured to rotate relative to and in contact with each other to connect or disconnect the first channel and the second channel, wherein, in a plane in which the first member and the second member are in contact, a first distance that is a distance of closest approach between the first channel and a valve circumference defined by a circumference of one of the first member and the second member having a smaller diameter is greater than a second distance that is a distance of closest approach between the second channel and the valve circumference, and wherein, letting the first distance be t1 and letting a diameter of the valve circumference be L, a ratio of the first distance to the diameter of the valve circumference, (t1/L), satisfies $0.07 \leq (t1/L) \leq 0.16$.

2. The cryogenic refrigerator as claimed in claim 1, wherein the first member is caused to rotate in the valve and the second member is stationary.

3. The cryogenic refrigerator as claimed in claim 1, further comprising:

a housing including a low-pressure space connecting to a suction side of the compressor to which a low-pressure working gas is returned, wherein the first member is accommodated in the low-pressure space.

* * * * *